US005816730A

United States Patent [19]

Alspaw et al.

[11] Patent Number: 5,816,730

[45] Date of Patent: Oct. 6, 1998

[54] PHOTOGRAPH DISPLAY BOOK

[76] Inventors: Deborah S. Alspaw, 5803 Goliad, Dallas, Tex. 75206; Alicia M. Harris, 7231 Lakewod Blvd., Dallas, Tex. 75214

[21] Appl. No.: 546,144

[22] Filed: Oct. 20, 1995

[51] Int. Cl.[6] ..... B42F 13/00

[52] U.S. Cl. ..... 402/79; 281/38; 281/22

[58] Field of Search ..... 402/79; 281/22, 281/38; 40/705, 725, 726, 745, 790

[56] References Cited

U.S. PATENT DOCUMENTS

| | | | |
|---|---|---|---|
| 1,719,648 | 7/1929 | Browne | 281/22 |
| 2,091,260 | 8/1937 | Farkas et al. | 40/726 X |
| 3,565,462 | 2/1971 | Gottlieb | 402/79 X |
| 3,797,152 | 3/1974 | Brandt | 402/79 X |
| 4,704,042 | 11/1987 | Eisen et al. | 402/79 |
| 4,965,948 | 10/1990 | Ruebens | 281/38 X |
| 5,031,935 | 7/1991 | D'Andrea | 281/15.1 |
| 5,066,046 | 11/1991 | Hoopingarner | 281/38 X |
| 5,082,312 | 1/1992 | Arrowood | 283/67 |
| 5,190,316 | 3/1993 | Hefty | 281/15.1 |
| 5,238,345 | 8/1993 | D'Andrea | 412/4 |
| 5,265,359 | 11/1993 | Glazer et al. | 402/79 X |
| 5,387,107 | 2/1995 | Gunter | 434/238 |
| 5,490,739 | 2/1996 | Olson | 402/79 |
| 5,509,746 | 4/1996 | Ho | 281/38 X |

FOREIGN PATENT DOCUMENTS

| | | | |
|---|---|---|---|
| 28 44 508 | 6/1979 | Germany | 402/79 |

*Primary Examiner*—Willmon Fridie, Jr.

*Attorney, Agent, or Firm*—William D. Jackson; Locke Purnell Rain Harrell, P.C.

[57] ABSTRACT

The present invention provides a photographic collection book which provides for an integrated assembly of pictorial representations such as cartoon characters and the like in combination with a photographic site to which a personalized photograph may be applied and a brief text or caption can be made to relate to the pictorial representation. A book embodying the present invention comprises front and back covers together with a plurality of pages between the covers configured to receive photographs fixed in place on the pages. Each of the pages can be made so as to convey a self-contained message or theme. A page has a site portion adapted to receive a photograph and a pictorial portion which is spaced horizontally from the site portion. The pictorial portion of the page has a cartoon character or characters or other pictorial representation which lies along side the site portion. A third component of the page is a caption portion spaced vertically from the site portion. The caption portion has a word caption such as a brief textual message which is located above or below the site portion, preferably the latter. The book is further provided with a pivotal binder which secures the book covers and intervening pages along their binding edges for easy movement through an arc of at least 180°. This allows pages in the book to lie flat when the book is opened and supported on a flat, solid surface.

20 Claims, 9 Drawing Sheets

PHOTOGRAPH DISPLAY BOOK

FIELD OF THE INVENTION

The present invention relates to photograph display books in which photographs may be applied to pages of the book and displayed in conjunction with capture and pictorial representations on the pages to present the photographs as a part of an integrated theme or story.

BACKGROUND OF THE INVENTION

It is a conventional practice to provide books such as storybooks and the like in which photographs, stickers, emblems or the like may be applied to pages of the book to present a theme or story which is personalized with respect to the reader or owner. For example, U.S. Pat. No. 5,387,107 to Gunter et al discloses a storybook in which photographs of the reader may be integrated with personalized characters presented in the book in conjunction with desirable messages to be conveyed to the reader. In the Gunter patent, the pages having a theme are interposed between relatively stiff front and back covers and are held in place by means of a suitable "backbone" or binder such as a stapled backbone, a spiral backbone or a hardbound backbone. The pages are configured so that when the book is open, opposing pages form a unit which conveys a message which is reinforced by the figure of a child which may be personalized by a photograph of the reader's likeness. For example, the head and shoulders of a personalized cartoon character may be presented with an overlying site within the photographic likeness of the reader's face may be affixed to the page. This may be accomplished by means of a lightly tacky adhesive which is provided on the site and covered by a release sheet which can be peeled away to present the adhesive surface. Alternatively, slots adapted to receive edges of the photographic likeness can be provided or an application area can be marked by a suitable boundary within which an adhesive substance such a liquid glue can be applied. The glue desirably is of the type that remains mildly tacking so that the photograph can be removed.

Yet another type of themebook for presenting a personalized theme or storybook is disclosed in U.S. Pat. No. 5,190,316 to Hefty. Here, the purchaser of the book provides the supplier with personalized messages or data which are to be applied to a plurality of stickers. Various textual messages such as the name and address of the child, the child's friends, relatives and other personal data can be applied to the stickers which in turn can be applied by the child to the passages of the book. The various stickers to be applied are of the self-adhesive "peel off" type or they can be held in place by an adhesive glue.

Yet another type of themebook is a photo advice book as disclosed in U.S. Pat. No. 5,082,312 to Arrowood which is designed for presentation to the honoree of a gathering such as a marriage, shower or birthday or the like. Here, when the book is opened, adjacent facing pages may be coordinated so that a photograph can be placed within a rectangular border on one page with the facing page containing text or a place in which to write textual messages. Alternatively, the border within which a photograph is to be placed, may be provided with corresponding indicia on the same page.

Other books for presenting a graphic theme or story with inserted photographs are disclosed in U.S. Pat. Nos. 5,031,935 and 5,238,345, both to D'Andrea. D'Andrea '935 contains apertured pages in which the apertures are aligned so that photographs secured in place on the inside of the front and rear covers can be viewed through the apertures as the pages are turned. Thus, the front and back sides of a given page present one figure in the aperture before the page is turned and the other figure secured to the inside of the front cover is visible through the aperture when the page is turned. A similar but somewhat more sophisticated arranged is disclosed in D'Andrea '345. Here, a plurality of aperture cutouts are aligned on page after page so the same underlying pictorial representation can be viewed in the different context provided by succeeding pages.

SUMMARY OF THE INVENTION

The present invention provides a photographic collection book which provides for an integrated assembly of pictorial representations such as cartoon characters and the like in combination with a photographic site to which a personalized photograph may be applied and a brief text or caption can be made to relate to the pictorial representation. A book embodying the present invention comprises front and back covers together with a plurality of pages between the covers configured to receive photographs fixed in place on the pages. Each of the pages can be made so as to convey a self-contained message or theme. Each page has a site portion adapted to receive a photograph and a pictorial portion which is spaced horizontally from the site portion. The pictorial portion of the page has a cartoon character or characters or other pictorial representation which lies along side the site portion. A third component of the page is a caption portion spaced vertically from the site portion. The caption portion has a word caption such as a brief textual message which is located above or below the site portion, preferably the latter. The book is further provided with a pivotal binder which secures the book covers and intervening pages along their binding edges for easy movement through an arc of at least 180°. This allows pages in the book to lie flat when the book is opened and supported on a flat, solid surface.

Preferably, the photograph receiving pages are configured to have site pictorial and caption portions on opposing surfaces thereof, with the site portion on one surface of the page being displaced relative to the site portion on the opposing surface of the same page. Thus, the site portion on the front side of one page does not completely overlie the site portion on the back side of the same page. Preferably, the opposing surfaces of the same page alternate in the relationship between the site portion and the pictorial portion. Thus, on one side of the page, the pictorial portion of the page is interposed between the site portion and the binding edge of the page. When the page is turned, the opposing surface of the same page presents a configuration in which the pictorial portion is interposed between the site portion and the outer edge of the page.

In yet a further embodiment of the invention, the book is provided with an instructional tear out page behind the front cover of the book. The tear-out page has indicia thereon which can be used to characterize the book and/or supply simple instructions. The tear-out page preferably is sufficiently transparent to allow the pictorial representation on the page underlying the tear out page to be seen through the instructional page.

In yet another embodiment of the invention, the book is configured so that the major dimension of the book is horizontal and the minor dimension is vertical. Here, the site portion of a page preferably comprises from about one-third to two-thirds of the total surface area of the page.

DESCRIPTION OF THE PREFERRED EMBODIMENTS

Figure 1:
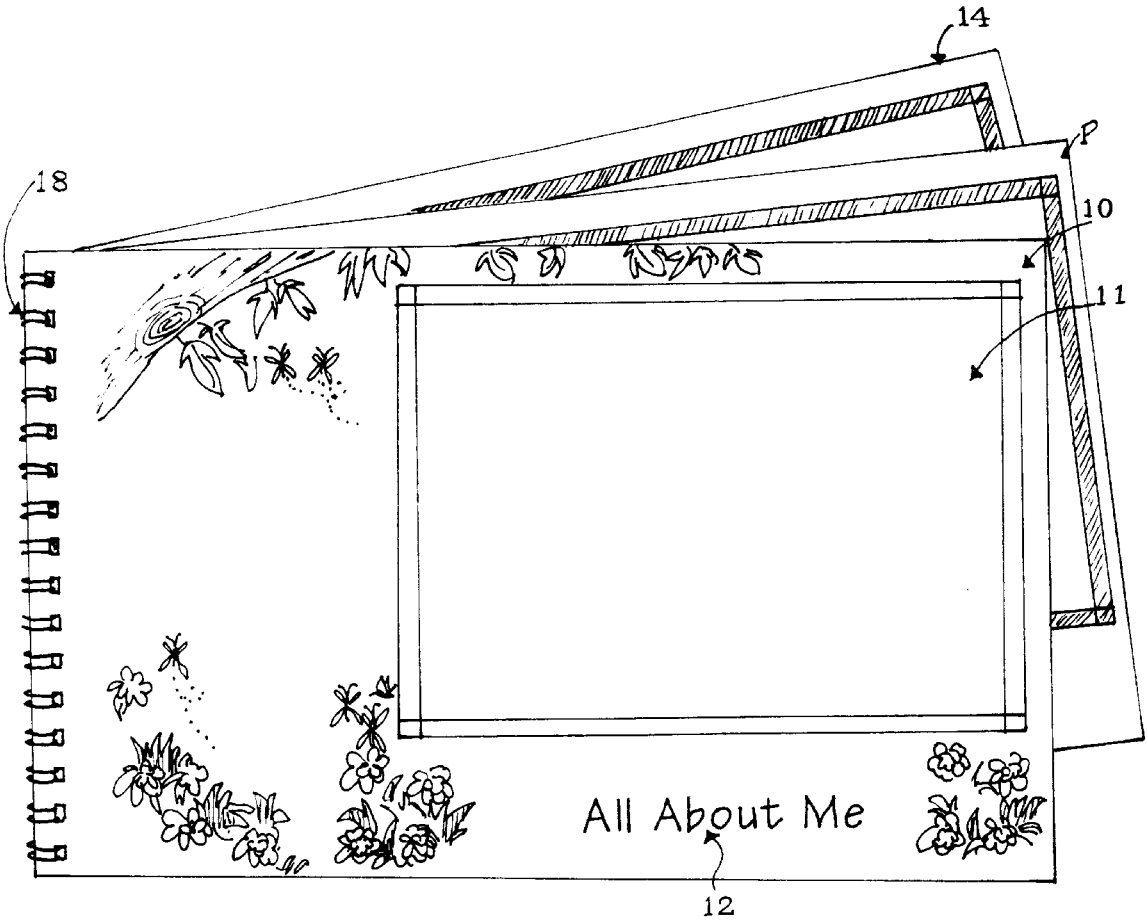
FIG. 1 is a perspective view of an integrated theme book embodying the present invention.
Figure 2:
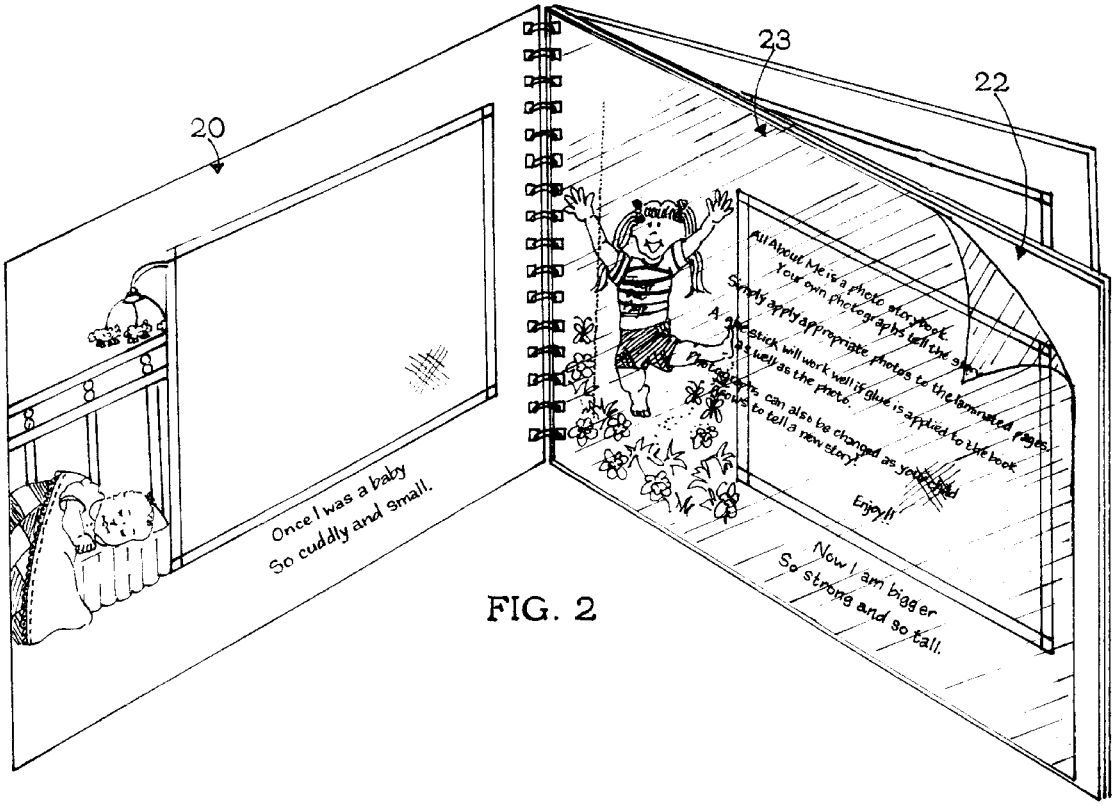
FIG. 2 is an illustration of the plan view of the book of FIG. 1 opened to expose two interior pages showing an instructional sheet.
Figure 3:
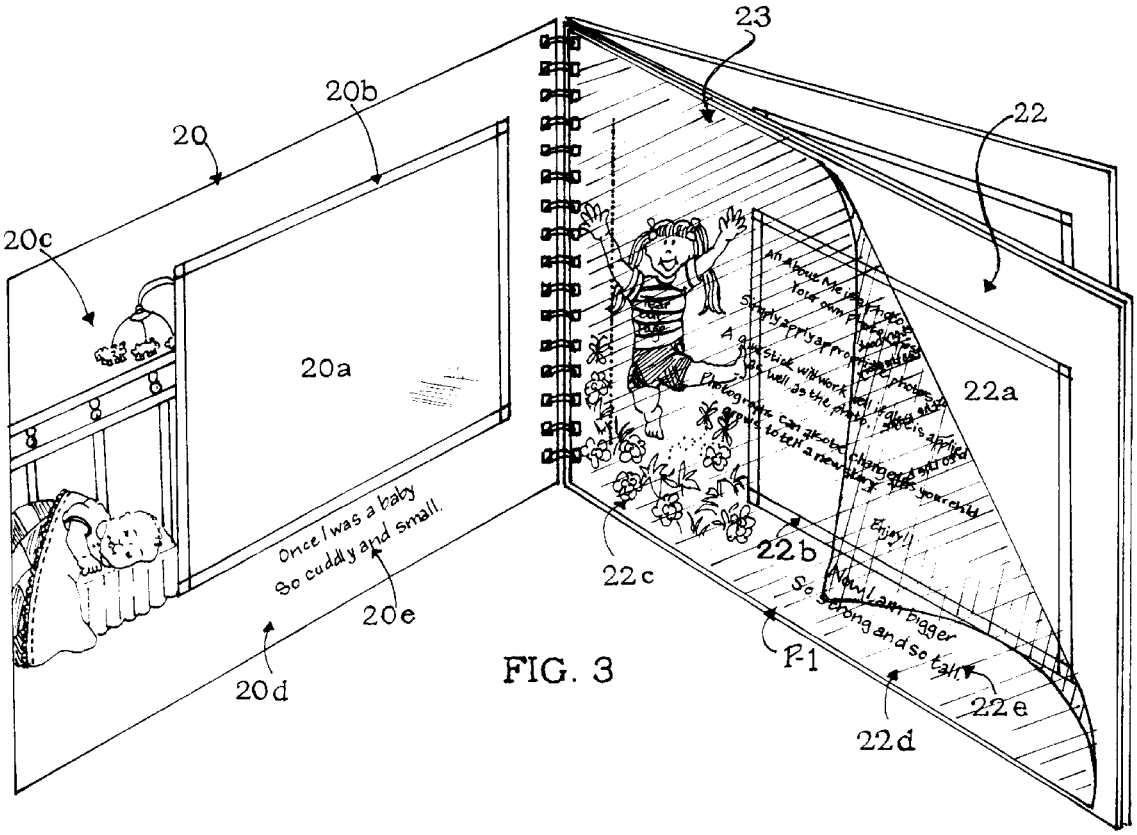
FIG. 3 is a plan view similar to FIG. 2 but with the instruction sheet turned back.

Turning now to the drawings and considering initially FIGS. 1, 2 and 3, there is illustrated an integrated photographic theme book embodying the present invention. As shown in FIG. 1, the theme book comprises a front cover 10 comprising a site portion 11, an underlying caption portion 12 presenting a theme together with intervening pages P and a back cover 14 secured together by pivoting binder 18 which permits the covers and intervening pages to be freely turned. The book shown in FIG. 1 is shown with the cover and intervening pages distorted somewhat to permit the lower edges of the back cover and intervening pages to be shown. In practice, it will be preferred to use a pivoting binder formed of individual ringlets, which are normal to the binding axis, as contrasted with so-called spiral bindings which are normally used as an alternative binding in themebooks and the like and which are biased somewhat with respect to the binding axis. As described hereinafter, this preferred form of binding permits the book to be opened and the pages turned while maintained in aesthetically pleasing alignment with one another. As shown in FIG. 1, the particular book illustrated is designed around a theme relating directly and personally to a child and carries the caption, "ALL ABOUT ME".

FIG. 2 is an illustration of the book of FIG. 1 with the front cover turned back to open the book and to expose two open page facings 20 (the back of the front cover) and 22, the latter being the front of page P-1 covered by a transparent instruction page 23. The instruction page carries a simple informational and instructional message as shown and is transparent so that the underlying page surface 22 can be seen through the instruction page. The instructional page which is formed of a material such as "onion skin", so that it can be easily torn from the book, preferably is of a somewhat shorter horizontal dimension than the remainder of the pages. For example, in the case of a book having dimensions of about 8½"×8¾", the onion skin instructional page may be about ¼" shorter (8½" along the major dimension) so as to ensure that the instructional page is totally contained within the book pages and is not likely to be accidentally accessed during handling.

Figure 4:
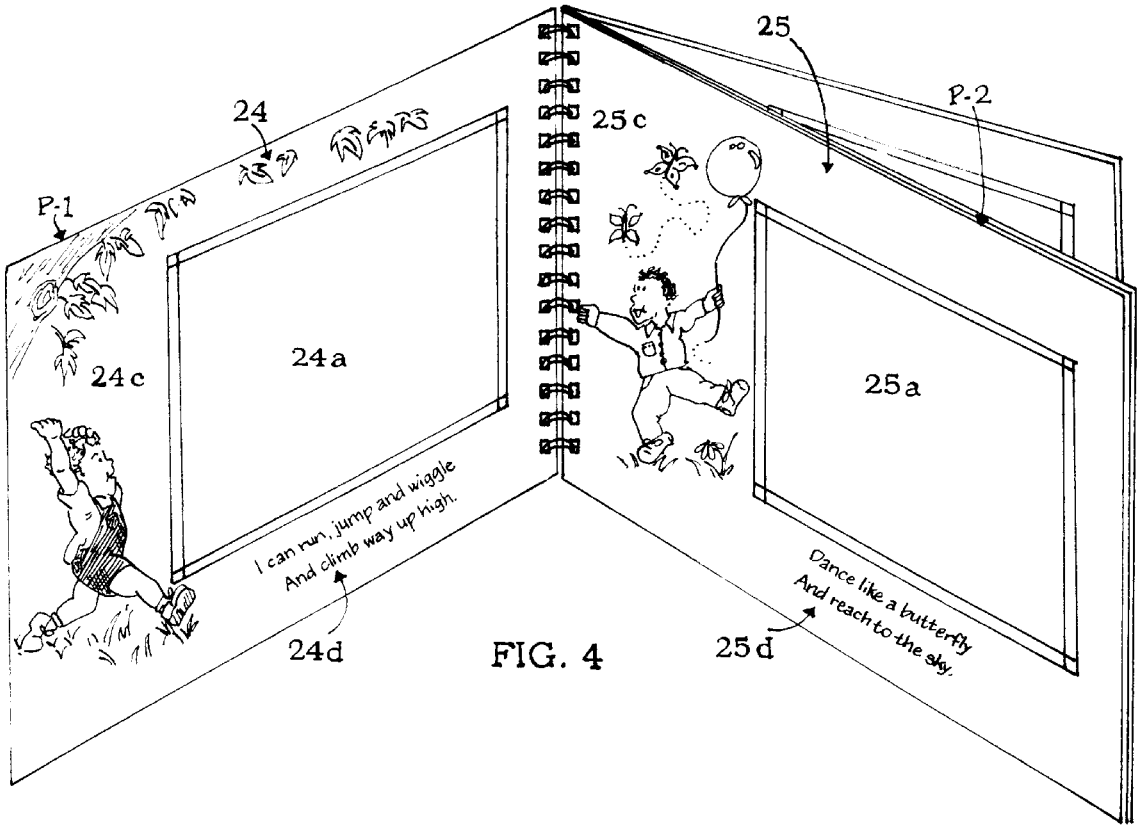
FIG. 4 is a plan view of the book of FIG. 1 with a page turned to reveal additional page surfaces.

FIG. 3 is a view identical to FIG. 2 but with the instructional sheet 23 turned back to more clearly disclose the underlying page surface 22 together with surface 20 of the preceding page. The page facing 20 is provided with a site portion 20*a* delineated by a border 20*b*, a horizontally spaced pictorial portion 20*c* and a vertically spaced caption portion 20*d* having an appropriate textual message as indicated by words 20*e*. Like portions of the surface facing 22 are indicated by reference numerals 22*a*–22*e*. As can be seen, the site portions 20*a* and 22*a* on surfaces 20 and 22, respectively, are of the same size and this convention will usually be observed going from page to page in the book. FIG. 4 illustrates the same book with the page P-1 turned over to reveal yet another set of facing page surfaces 24 (the back of page P-1) and 25 (the front of the next page P-2). The site, pictorial, and caption portions of surface 24 are indicated by reference numerals 24*a*, 24*c* and 24*d*, respectively and the corresponding portions of page facing 25 are likewise indicated by reference numerals 25*a*, 25*c* and 25*d*, respectively. Thus, as can be seen from an examination of FIGS. 2–4, each page is totally self-contained in that it carries site portion upon which a photograph can be mounted, a caption portion located below the photographic site and a pictorial portion to the left of the photographic site and having a functional relationship to the caption presented on the page.

In the arrangement illustrated in FIGS. 2–4, each page surface is completely self-contained so that a photograph can be secured on each page surface which contains a more or less complete and self-contained message. However, as the pages are turned to expose succeeding page surfaces, an integrated theme, in this case representative of child's activities, is presented.

The use of discreet pages rather than presenting a single "message" or the like across two facing pages offers several advantages. First, the child is allowed to focus on a single subject at the time, with each subject, although part of an integrated theme, being associated with a single photograph. This allows the child to remain focused on a single page without the distraction offered by trying to assembly an arrangement spread over several pages with the accompanying distraction and possible loss of interest. Secondly, this arrangement allows a large number of photographs, one per page surface, to be incorporated into the book while still presenting a booklet of reasonable bulk and of a size that can be easily handled by a child.

Where the incorporation of a maximum number of photographs into the book is not a desideratum, open facing pages of the book can be treated as one unit. In this embodiment of the invention, one page surface when the book is open, normally the left-hand page surface, contains a photographic site portion and a caption portion as described previously. This page surface may or may not also contain a pictorial portion. The page surface to the right of the binder can here be devoted in its entirety to a pictorial representation which can be integrated with the caption portion on the left-hand surface similarly described above. This arrangement still offers the advantage of providing a more or less complete single entity being exposed to the child as he or she turns the pages.

The arrangement shown in FIGS. 1–4 further offers an advantage of having the pictorial portion to the "left" of each photographic site portion as the page is turned. This not only offers a repeatable configuration which is satisfactory to the child and presents a pleasing regularity which minimizes frustration as the pages are turned, it also results in the actual photographs being distributed generally across the surface of the pages from the binder edge to the outer edge. In this respect, it can be seen that the site portion 24*a* on page surface 24 of page P-1 (FIG. 4) is next to the binder edge, whereas the site portion 22*a* on the immediately preceding page surface 22 of page P-1 (see FIG. 3) is next to the outer edge so that the photographic site portions on opposing surfaces of the same page are not contiguous but are displaced with respect to one another so that they only partially overlap. This tends to keep the book of a more or less uniform thickness throughout as the pages are progressively filled with photographs.

The pages of the book can be of any form suitable to receive a photograph, but preferably have a high gloss surface. A preferred construction is achieved through the use of so-called film laminate imposed upon an intervening core of paper goods. This results in a rugged construction which can be handled by children without damage to the book while presenting a book that can be kept clean by wiping with a damp rag without distortion of the pictorial representations or the word captions thereon. Preferably, each page has a thickness of about 12–18 mils. A suitable construction can be arrived at by coating the paper core (about 8 mils thick) on both side with a film laminate of about 3 mils. thickness per side, providing an overall page thickness of about 14 mils. Preferably, the pictorial representations and word captions are applied to both sides of the paper core initially and the film laminates then applied to the opposing surfaces by any suitable means. For example, after the desired indicia and pictorial representations are applied, a plastic laminate film is applied to the core and then heated to fix the laminate to the paper core. Any other suitable procedure for applying the laminate films to the paper surfaces may, of course, be employed. A suitable laminate film is the product identified as the Transkote laminating film available from the Sealtran Corporation. The film is formed from a polymer mixture of polyethylene, polyethylene co-polymers and polyesters.

While the book may be provided with hard front and back surfaces, it usually will be preferred to provide the front and back covers of the book with the same laminate material as employed in forming the pages. This keeps the book down to a moderate thickness and allows the book as a whole to be relatively flexible so that it can be handled by children without frustration. Preferably, the book has an overall thickness, including the covers, before insertion of the photographs of about 3/16 of an inch or less. For example, using the foregoing construction, a book having front and back covers and six intervening pages P (providing a total of 12 internal page surfaces front and back), can be provided in a book having a thickness of only about 1/8" before the photographs are secured in place. Where the photographs applied are conventional 3×5 color prints, the overall thickness of the book is only about 1/4" after insertion of the photographs on both sides of the interior pages.

It is important that the site portion of the pages form a substantial portion of the overall area of the page. Preferably, the site portion of each page will occupy about 1/3 to 2/3 of the total surface area of the page. By way of example, the booklet dimensioned with 5½" along the shorter vertical edge and about 8¾" along the longer horizontal edge, a book with pages of this size can readily accommodate photographs of standard 3½"×5" size photographs or even 4"×6" photographs. These dimensions are representative of the preferred embodiment of the invention in which the book is configured with a horizontal dimension that is somewhat greater than the vertical dimension. Preferably, the ratio of the horizontal dimension to the vertical dimension of the pages of the book is within the range of about 1.4–1.7.

Preferably, the site portions of the pages are delineated by bold borders such as indicated by reference numerals 20*b*, 22*b*, etc. in order to clearly delineate the site portion relative to the pictorial and caption portions. The borders preferably are brightly colored and it will usually be preferred to color the borders on successive pages with different colors whereby the child's interest will be sustained by encountering the different colors as he/she turns the pages.

Figure 5:
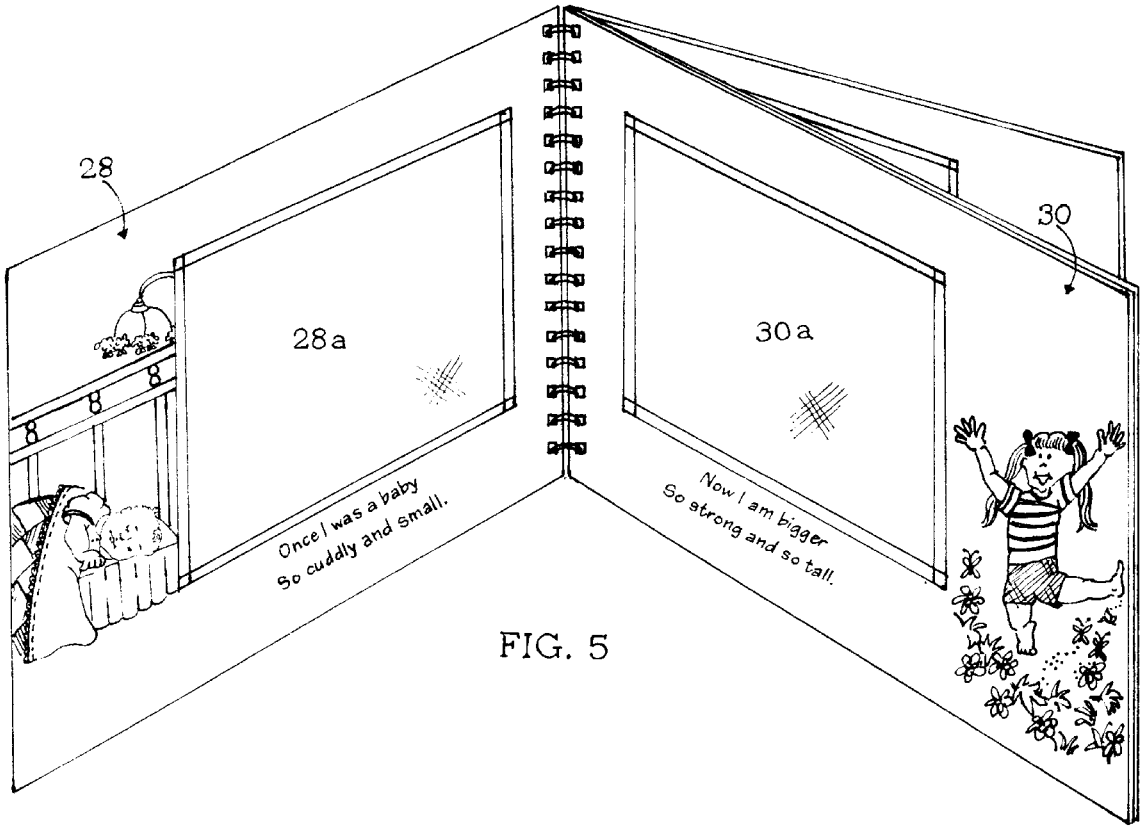
FIG. 5 is a plan view of a yet another embodiment of the invention with the book open to expose interior pages.

Turning now to FIG. 5, there is illustrated an alternative embodiment of the invention in which the photographic site portions are configured on succeeding page surfaces 28 and 30 so that in each case, the photographic site 28*a* and 30*a* is next to the binder. While this configuration does not offer the advantage of successively displaced site portions so that they do not completely overlap on opposing page surfaces as described previously, it can be useful where the pages are not as rugged as when employing the high gloss laminate construction described previously. For example, where the pages are made of ordinary paper or even relatively thick "cardboard" type paper stock, the pages can be more easily torn from the book than in the case of the laminated page design. In this case, the photographic site can be located next to the binding edge, so that the pictorial portion is alternatingly on the left and on the right side of the site portion as shown on FIG. 5, in order to lessen the likelihood of damage to the pages or the photographs which might result from a relatively thick photograph being placed on the outer edge of a relatively thin or weak paperstock.

Figure 6:
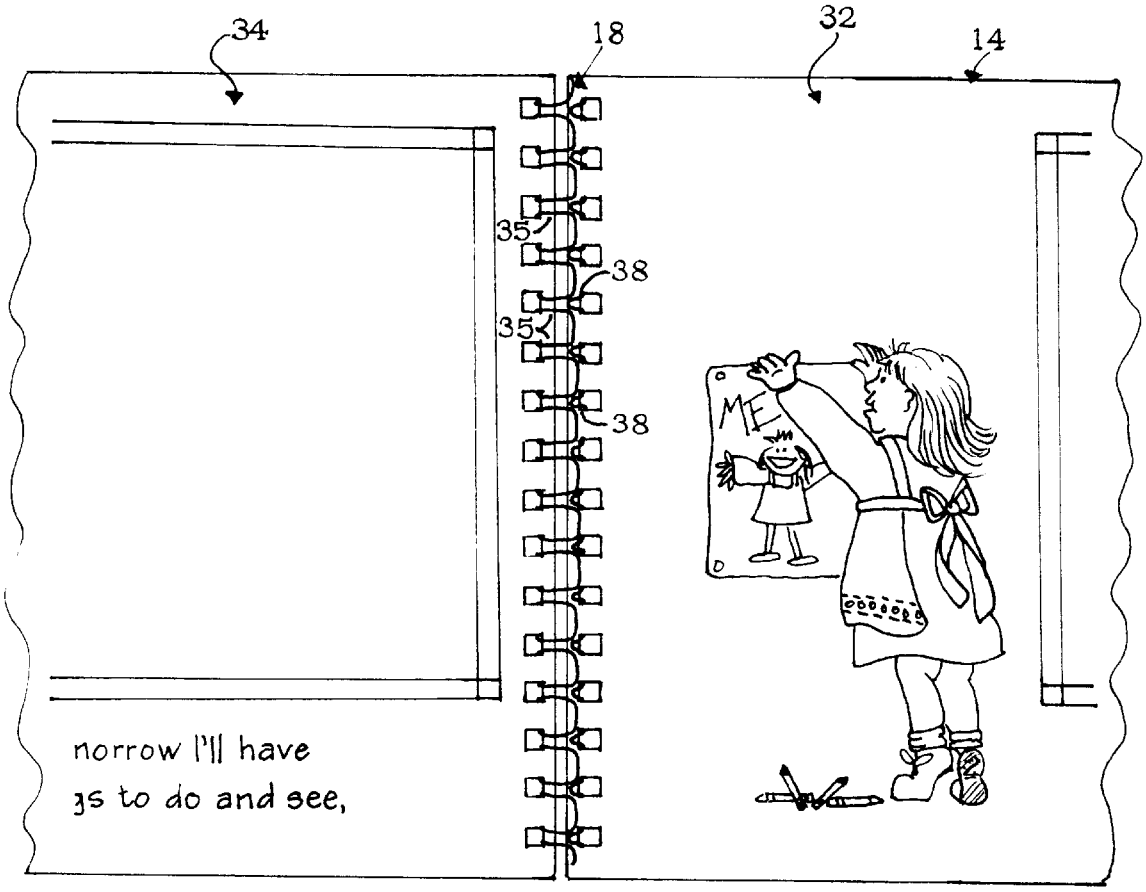
FIG. 6 illustrates a preferred form of binder employed in carrying out the present invention.
Figure 7:
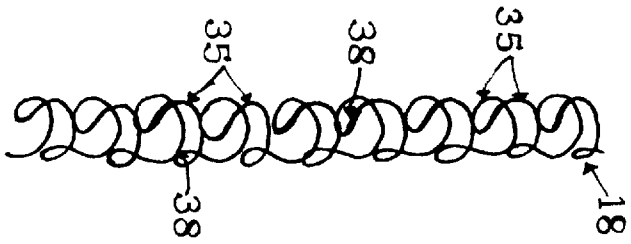
FIG. 7 is a perspective view of the binder shown in FIG. 6.

FIG. 6 illustrates the preferred form of binder mechanism which is employed in carrying out the present invention. FIG. 6 is a partial view of the book of FIG. 1 with the book being opened at the last page to expose the interior surface 32 of the back cover 14 and the back page surface 34 of the next preceding page. The binder mechanism 18 is also shown in the perspective view of FIG. 7 as it might exist without the pages in place. As shown in FIGS. 6 and 7, the binder mechanism 18 comprises a plurality of individual ringlets 35 which are normal to the binding edge of the pages. As can in FIGS. 6 and 7, each of the ringlets are actually bifurcated with interconnecting bight segments 38 which extend from one ringlet to the other and provide an interconnecting support for the ringlets. As illustrated, it forms a unitary structure while at the same time avoiding the skew or bias incorporated into a binding such as provided by a spiral binding or the like. Bindings of the nature employed in the present invention are in the nature of the so-called "wire-O" bindings available from James Burn, Inc. An alternative binding which similarly avoids the disadvantages use of spiral bindings and the like is provided by so-called plastic coiled bindings where again individual ringlets fit through the pages and are interconnected by a support structure extending from one ringlet to the next. Again, the ringlets are generally normal to the interconnecting support structure, that is, they are not skewed relative to the support structure or the edges of the pages. From the foregoing description, it will be recognized that adhesive book bindings or staple-type binding as disclosed, for example, in the aforementioned patent to Gunter preferably should be avoided in the preferred embodiment.

The photographs may be fixed in place by any suitable technique. For example, glue sticks may be employed by applying glue to the back of a photograph as well as to the site portion of the page. When high gloss or "slick" paper surfaces are involved, the photograph, while adhering to the page surface, can usually be peeled off to permit another photograph to be put in its place. Alternatively, a lightly tacky adhesive of the type described in the aforementioned patent to Gunter can be employed. Here, a release strip (not shown) can be employed over the site portion when the book is in the original condition prior to the addition of photographs. As photographs are added, the release portion on a given page can be exposed to reveal the tacky surface within the site portion and the photograph then applied.

Figure 8:
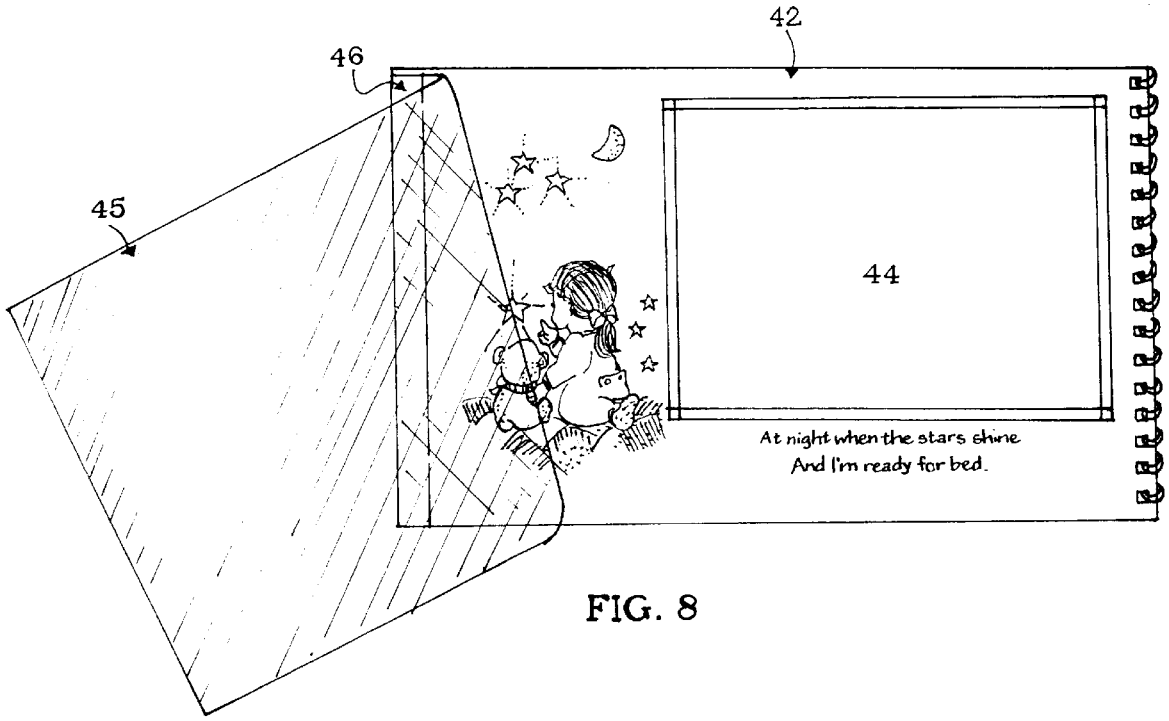
FIG. 8 is a view of the book illustrating yet another embodiment of the invention.

FIG. 8 of the drawings shows yet another embodiment of the invention incorporating a different type of page which can be employed. In FIG. 8, only a single page 42 is shown in plan and perspective view to illustrate the use of complete release sheets on both sides of a paper substrate which is coated with a suitable material to make it lightly tacky. As shown in FIG. 8, the page 42 before application of the photograph to the site 44 is completely covered with a release sheet 45 which is glued to the page along the outer distal edge 46 of the page 42. The release sheet covers the entire page, but stops short of the apertures through which the binding material is inserted by perhaps ¼". When it is desired to place the photograph in place, the release sheet is pulled back to the configuration shown in FIG. 8, the photograph put in place within the site portion and the transparent release covering 45 then returned to its original position, so that it covers the photograph as well as the caption and pictorial portions. The backside of the page 42 (not shown) is similarly configured with a transparent release sheet.

Figure 9:
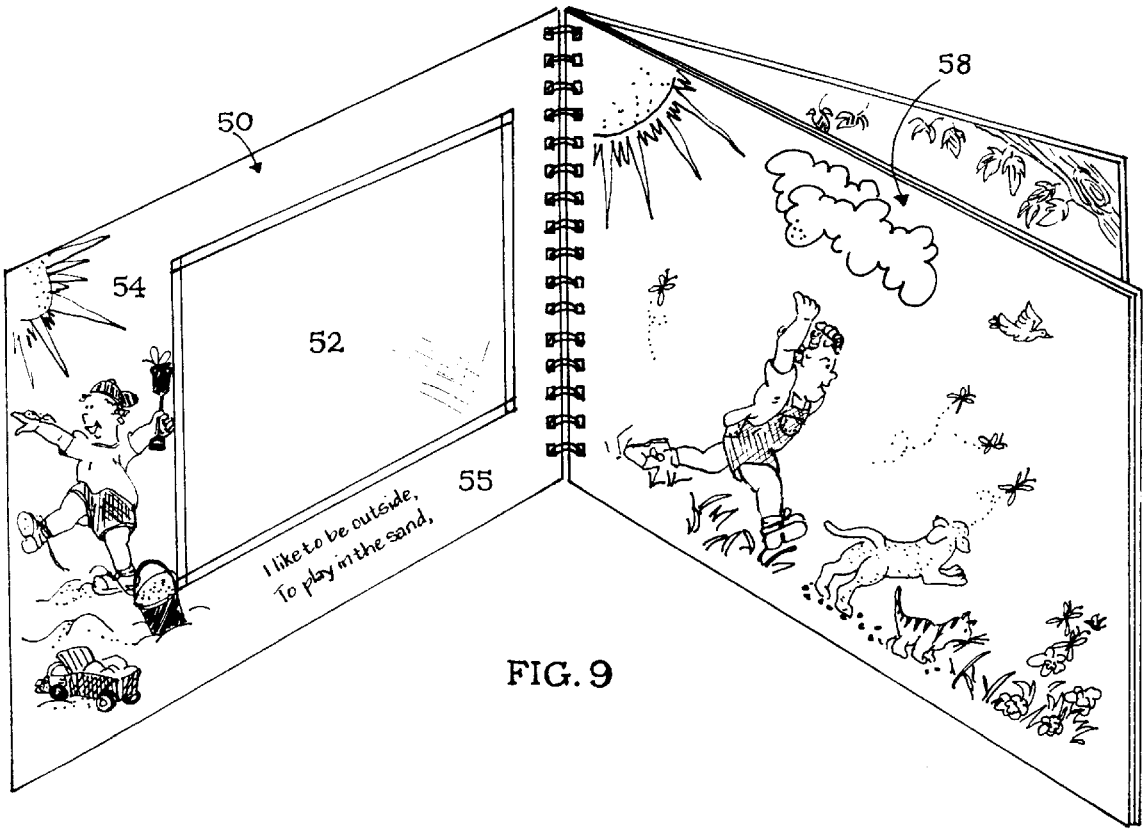
FIG. 9 is a plan view of the open book to illustrate yet another embodiment of the invention.

FIG. 9 illustrates another embodiment of the invention, as described previously, in which some of the open facing pages of the book are treated as one unit. As illustrated in FIG. 9, the left-hand page 50 comprises a site portion 52, a pictorial portion 54 and a caption portion 55. Similarly as described above, the facing page surface 58 is devoted entirely to presenting a pictorial portion which is to be read in conjunction with the caption shown in the left-hand page surface blank. In this embodiment of the invention and described previously, the page surface 50 need not contain a pictorial portion, instead the page surface being devoted entirely to a photographic site and an appropriate caption.

Having described specific embodiments of the present invention, it will be understood that modifications thereof may be suggested to those skilled in the art, and it is intended to cover all such modifications as fall within the scope of the appended claims.

What is claimed:

1. In a photograph collection book, the combination comprising:

a. front and back covers for said book having binding and outer edges;

b. a plurality of pages therein having binding and outer edges at least some of which are configured to receive photographs fixed in place on the surfaces of the pages;

c. at least some of said pages having a site portion thereon on the surface adapted to receive and support a photograph; a pictorial portion on the surface spaced horizontally from said site portion and having a pictorial representation thereon which lies to the side of said site portion; and a caption portion on the surface spaced vertically from said site portion and having a word caption thereon; and d. a pivoting binder in said book securing said covers and said pages in said book along their binding edges for movement throughout an arc of at least 180° to allow opposing pages in said book to lie flat when said book is supported on a surface.

2. The combination of claim 1, wherein said binder comprises a plurality of wire ringlets to allow free movement of said pages as the pages are turned.

3. The combination of claim 1, wherein said pages adapted to receive a photograph are configured to have site, pictorial and captions portions on opposing surfaces thereof.

4. The combination of claim 3, wherein the site portion on one surface of a page is displaced relative to the site portion on the opposing surface of the same page whereby said site portions do not completely overlap.

5. The combination of claim 4, wherein the pictorial portion on one of said pages is interposed between the site portion and the binding edge of the page and the pictorial portion on the opposing surface of the same page is interposed between the site portion and the outer edge of the page.

6. The combination of claim 1, wherein said pages have high gloss surfaces.

7. The combination of claim 6, wherein said pages have a thickness within the range of about 12–18 mils.

8. The combination of claim 7, wherein said pages are laminated pages having a center layer upon which said pictorial representations and said word captions are imprinted on both sides of said center layer and clear plastic laminated on said opposing surfaces of said core layer provide said high gloss surfaces.

9. The combination of claim 1, wherein each of said page surfaces is integrated between the caption portion and the pictorial portion in a manner to convey a representation which is independent of subject matter found on the facing page surface when said book lies open upon a supporting surface.

10. The combination of claim 1, wherein said at least some of the pages of said book comprise an interior layer having said pictorial representations and captions imprinted thereon and adapted to support a photograph on the site portion of said page and further comprising a transparent segment secured to said page along one edge thereof and overlying said page in an adhering relationship which allows said segment to be peeled back from said page to permit the photograph to be placed on the site portion of said page and thereafter returned to an overlaying relationship with said page.

11. The combination of claim 1, wherein opposing surfaces of said pages are configured so that the site portion of each surface of the page is located adjacent to the binding and the pictorial portion is located intermediate the site portion and the outer edge of the binding.

12. In a photograph collection book, the combination comprising:

a. front and back covers for said book having binding and outer edges;

b. a plurality of pages therein having binding and outer edges at least some of which are configured to receive photographs fixed in place on the surfaces of the pages;

c. a pivoting binder in said book securing said covers and said pages in said book along their binding edges for movement throughout an arc of at least 180° to allow opposing pages in said book to lie flat when said book is open and supported on a surface, said binder comprising a plurality of ringlets which are generally normal to an interconnecting support structure for said ringlets extending along the binding edge and which allow free movement of said pages as the pages are turned;

d. at least some of said pages having a page surface with a site portion thereon adapted to receive and support a photograph and a caption portion on the surface spaced vertically from said site portion and having a word caption thereon; and e. when said book is open at least some of said pages having a pictorial portion spaced horizontally from a site portion on the same or on the opposite page and having a pictorial representation thereon which is spaced so that it lies to the side of said site portion.

13. The combination of claim 12, wherein at least some of said pages adapted to receive a photograph are configured to have site, pictorial and captions portions on opposing surfaces thereof.

14. The combination of claim 12, wherein at least some of the pages in said book are configured so that when said book is open, one page surface has a pictorial portion and the opposing page surface has a site portion.

15. In a photograph collection book, the combination comprising:

a. front and back covers for said book having binding and outer edges;

b. a plurality of pages therein having binding and outer edges at least some of which are configured to receive photographs fixed in place on the surfaces of the pages;

c. at least some of said pages having a site portion thereon on the surface adapted to receive and support a photograph; a pictorial portion on the surface spaced horizontally from said site portion and having a pictorial representation thereon which lies to the side of said site portion; and a caption portion on the surface spaced vertically from said site portion and having a word caption thereon;

d. a pivoting binder in said book securing said covers and said pages in said book along their binding edges for movement throughout an arc of at least 180° to allow opposing pages in said book to lie flat when said book is supported on a surface; and e. an instructional tear out page behind the front cover of said book having indicia thereon and being sufficiently transparent to allow the pictorial representation on the underlying page to be seen through the instructional page.

16. In a photograph collection book, the combination comprising:

a. front and back covers for said book having binding and outer edges;

b. a plurality of pages therein having binding and outer edges at least some of which are configured to receive photographs fixed in place on the surfaces of the pages;

c. at least some of said pages having a site portion thereon on the surface adapted to receive and support a photograph; a pictorial portion on the surface spaced horizontally from said site portion and having a pictorial representation thereon which lies to the side of said site portion; and a caption portion on the surface spaced vertically from said site portion and having a word caption thereon;

d. a pivoting binder in said book securing said covers and said pages in said book along their binding edges for movement throughout an arc of at least 180° to allow opposing pages in said book to lie flat when said book is supported on a surface; and e. said book being configured so that the major dimension of said pages is horizontal and the minor dimension of said pages is vertical.

17. The method of claim 16, wherein the ratio of the horizontal dimension to the vertical dimension of said pages is within the range of about 1.4–1.7.

18. The combination of claim 16, wherein the site portion of said pages comprises from one-third to two-thirds of the total surface area of said page.

19. The combination of claim 16, wherein the site portion of said page is delineated by a colored border separating said site portion from said pictorial and said caption portions.

20. The combination of claim 19, wherein the borders on said pages are of several different colors, whereby when one turns the pages they are exposed to different colored borders delineating said portions.

* * * * *